United States Patent [19]

Brooks et al.

[11] 4,109,499

[45] Aug. 29, 1978

[54] ROLL FORMING APPARATUS AND METHOD

[75] Inventors: Barlow W. Brooks; Barlow W. Brooks, Jr., both of Anchorage, Ky.

[73] Assignee: Roll Forming Corporation, Shelbyville, Ky.

[21] Appl. No.: 769,225

[22] Filed: Feb. 16, 1977

[51] Int. Cl.[2] ..... B21D 5/14

[52] U.S. Cl. ..... 72/181; 72/245

[58] Field of Search ..... 72/181, 182, 179, 176, 72/246, 245, 32, 260

[56] References Cited

U.S. PATENT DOCUMENTS

| | | | |
|---|---|---|---|
| 1,317,581 | 9/1919 | Kipniss et al. | 72/181 X |
| 2,040,755 | 5/1936 | Meyer | 72/6 |
| 2,232,964 | 2/1941 | Parrish et al. | 72/181 |
| 2,397,608 | 4/1946 | Johnson | 72/245 X |
| 2,582,062 | 1/1952 | Peters et al. | 72/181 |
| 3,085,146 | 4/1963 | Ferreruela | 72/181 X |
| 3,447,351 | 6/1969 | Werntz | 72/181 |
| 3,595,053 | 7/1971 | Oppermann | 72/181 |
| 3,636,903 | 1/1972 | Anderson et al. | 72/181 X |
| 3,653,878 | 4/1972 | Jonghe | 72/181 |
| 3,665,743 | 5/1972 | Frohling | 72/11 |

*Primary Examiner*—Milton S. Mehr
*Attorney, Agent, or Firm*—Dybvig & Dybvig

[57] ABSTRACT

A readily adjustable, constant pressure is exerted upon forming rolls of a roll forming machine for ease in setup and to accommodate variations in stock characteristics. In one embodiment, the upper rolls are mounted in a fixed position on roll stands and the lower rolls are supported by hydraulic actuators affixed to the bed of the machine. Alternatively, the lower rolls may be fixed and the upper rolls connected to actuators. As a further alternative, both the upper and the lower forming rolls may be supported by actuators. Hydraulic circuitry for controlling the actuators including regulator devices and gauges at each roll stand is also illustrated.

29 Claims, 5 Drawing Figures

ROLL FORMING APPARATUS AND METHOD

BACKGROUND OF THE INVENTION

This invention relates to a roll forming apparatus and method of the type used to cold form metal from sheet, strip or coiled stock into various cross sectional shapes which are typically essentially uniform. The process of roll forming is also known as contour roll forming or cold roll forming. It differs from other rolling operations in which rolling mills are used to reduce metal thickness. In roll forming operations, the metal stock is bent into a desired shape and the gauge of the stock is not appreciably reduced except in the areas where the material is bent.

Roll forming machines generally comprise a series of pairs of parallel spindles or shafts mounted on roll stands for rotation about spaced, horizontal axes. The shafts of each pair rotate in opposite directions so that forming rolls or dies mounted on the shafts both feed and bend the metal stock as it passes therebetween.

Prior art roll forming machines have included mechanisms for rotatably driving either one or both of each pair of shafts. In most conventional roll forming machines, the lower shaft is held in a permanent position relative to the machine bed and the position of the upper shaft is vertically adjusted relative to the lower shaft by means of screw adjusting mechanisms.

A vertical adjustment of at least one of the shafts is necessary to allow for adjustment of the clearance between mated pairs of forming rolls or dies so that the metal can pass therebetween and be formed thereby. Also, the base diameters of successive pairs of rolls or dies normally progressively increase so as to constantly place the metal stock under tension. Accordingly, the separation of the pairs of shafts at the beginning end of a roll forming machine is usually less than the separation of the pairs at the finish end.

Vertical adjustment of the rolls is also required because the pressure to be applied by one pair of rolls may be different from the pressure to be applied by other pairs of rolls because of differences in the forming operations that take place as the stock passes through the successive pairs of rolls. Because of the importance and criticality of this adjustment, the roll stands usually have a scale and pointer arrangement so that the specific location of the upper shaft can be noted for future reference. However, such arrangements are not reliable because, as parts become worn, the pointer and scale arrangements do not accurately indicate the positions of the upper shafts.

When a roll forming machine is first set up to produce a given shape, the positions of the upper shafts relative to the lower shafts are adjusted as necessary. The compressive load applied to the metal stock by the screw adjustments depends to a substantial degree upon the experience of the person doing the setup and, in practice, the specific pressure applied is a matter of "feel". Normally several years are required before a setup man has gained the requisite experience to satisfactorily make the screw adjustments. Since roll forming operations require plural pairs of rolls, even an experienced setup man may need a substantial amount of time to set up a particular job. After the shafts are properly set to produce a good part, additional adjustments may be required if the gauge of the metal changes or the physical properties of the metal change. Change in metal thickness is a common problem because of dimensional variations in the thickness of available metal stock, both across the width of the stock and along its length. If the stock becomes too thin, the forming rolls no longer properly mate with the stock with the result that the part will not be properly formed. The same may happen if the metal thickness increases. Also a jam may occur, causing damage to the shafts or to the forming rolls or other damage to the machine. In some cases, the metal thickness itself will be decreased by the forming rolls and, again, the part will be improperly formed.

If the machine is set up to produce a part one day, and then set up for other jobs, and subsequently set up to produce the same part at a later date, the entire setup procedure must be undertaken anew. That is, in typical factory operations, the upper shaft locations for producing a particular shape are not retained for use when the same shape is to be produced at a later date since, as noted above, the shaft locations are not readily reproducible and it is just as easy for the setup man to set the job up all over again.

SUMMARY OF THE INVENTION

In accordance with this invention, at least one of each pair of forming roll shafts or spindles is movably mounted with respect to its mating forming roll shaft or spindle and is subjected to an adjustable, uniform pressure. In the embodiments illustrated herein, the uniform pressure is obtained by the use of hydraulic actuators and associated hydraulic circuitry that serve both to support the shafts in position and also to maintain a compressive load on the shafts and, accordingly, the forming rolls and the metal stock being formed. It is contemplated that force applying means other than hydraulic actuators could be used for this purpose.

By virtue of this invention, the compressive force applied to the forming rolls and the metal stock passing therebetween is maintained uniform regardless of normal variations in stock thickness and changes in the physical characteristics of the stock. For metal stock having a given set of characteristics, a slight increase in thickness will cause the forming rolls to spread further apart so that cold working of the material or jamming and damage to the machine or the material is avoided. The spreading apart of the rolls is made possible because of the hydraulic circuitry of this invention which maintains a uniform pressure upon the rolls. If the stock passing between the rolls becomes thinner, the rolls simply move closer to one another so that the proper mating of the rolls and the stock is maintained. As a consequence, after a roll forming machine made in accordance with this invention is properly set up to produce a part, the part will be properly formed regardless of any normal variations in stock thickness. The same is true if slight changes in the temper of the metal stock occur.

In the presently preferred embodiment of this invention, the locations of the upper shafts are fixed and the lower shafts are supported by the pistons of hydraulic actuators. The actuators are mounted on the machine bed under each roll stand and valve and pressure regulator control means are mounted adjacent the roll stands in positions convenient to regulate the pressure to be applied. The various forming rolls can be quickly adjusted to apply proper pressures and, in the event of extreme changes in physical characteristics of the metal stock which would require further adjustment of the pressures, such further adjustment can readily be accomplished.

After experience has been gained in the use of roll forming machines made in accordance with this invention, it should be possible to accurately predict the pressure to be applied to the stock by each pair of forming rolls. Pressure gauges are preferably associated with each pair of forming rolls so that, in order to set up the machine, one need merely set the pressure regulator to the predicted pressure so that comparatively little time will be required to completely set up the machine. Any adjustments in pressure required can be noted for future reference for use when the machine will be used to produce the same shape at a later date.

Further in accordance with this invention, it is contemplated that both rolls of each pair could be supported and positioned by hydraulic actuators or other force applying means, or only the upper rolls could be so supported and positioned. If both rolls of a set of roll stands are positioned by hydraulic actuators, it is desirable that at least a pair of stands having one fixed roll position be used to establish a pass line.

In general it is an object of this invention to provide an improved roll forming apparatus and method. Other objects and other advantages will be apparent from the following description.

BRIEF DESCRIPTION OF THE DRAWINGS

FIG. 1 also illustrates a section of stock being formed.

DESCRIPTION OF THE PREFERRED EMBODIMENTS

Figure 1:
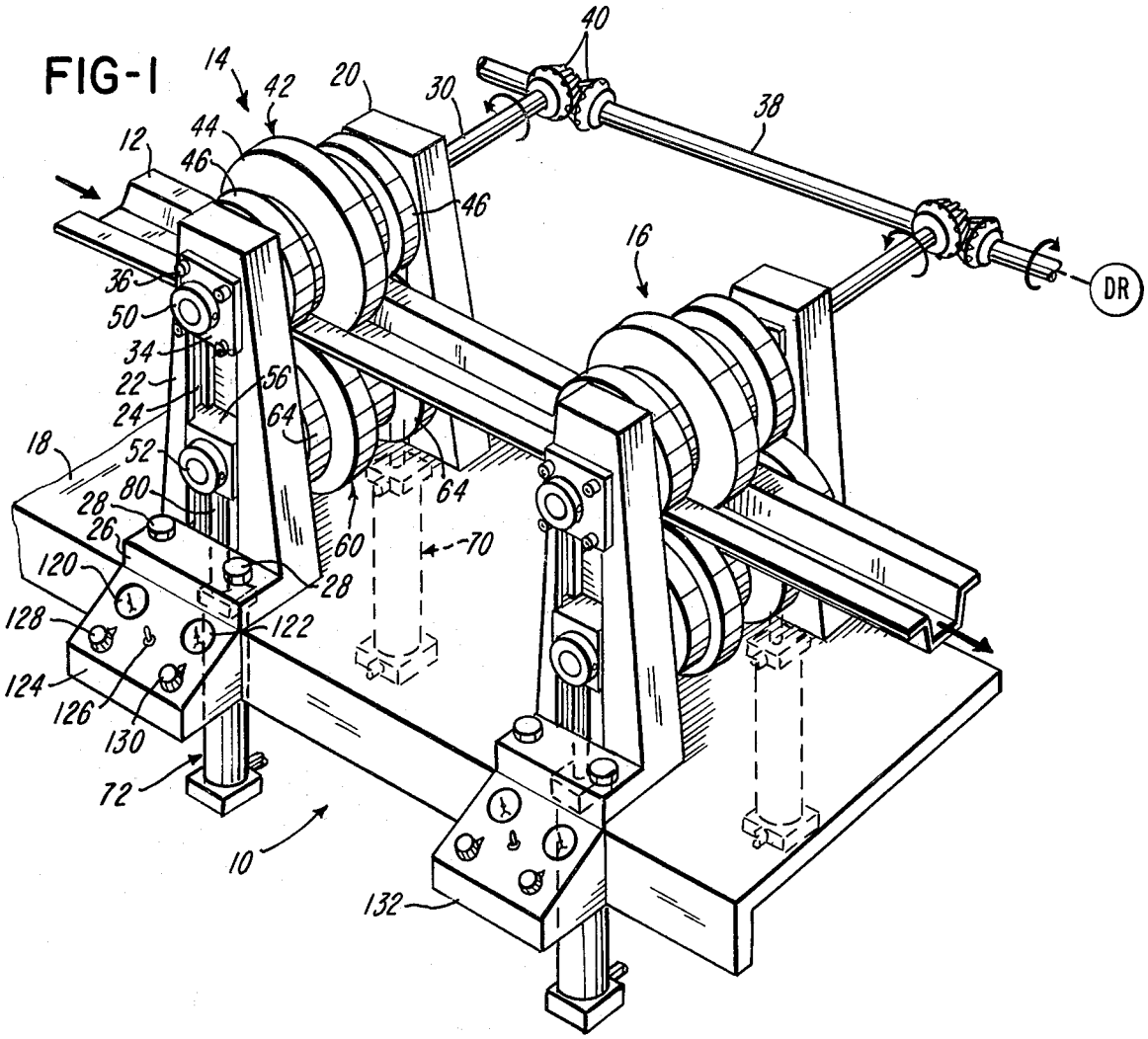
FIG. 1 is a simplified, perspective view of a portion of the presently preferred embodiment of a roll forming machine operating and constructed in accordance with this invention.
Figure 2:
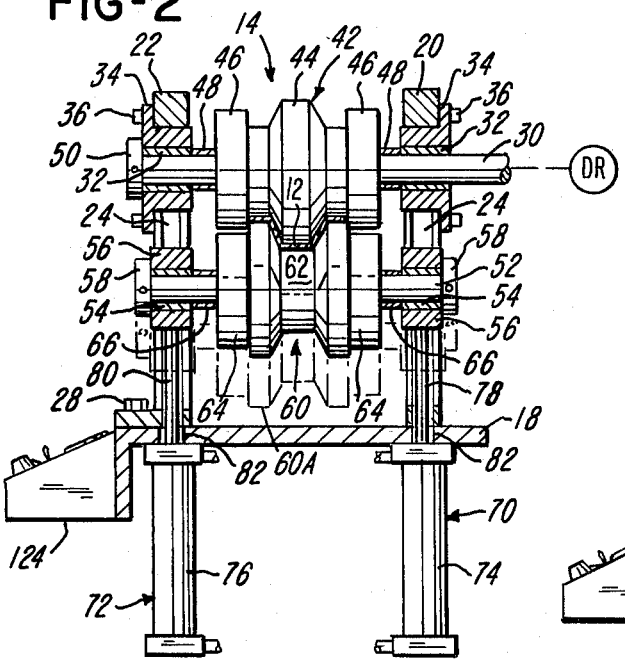
FIG. 2 is a side elevation view with parts in cross section of a portion of the machine and the stock of FIG. 1.

With reference to FIGS. 1 and 2, a portion 10 of a roll forming machine is illustrated that has been set up to progressively form metal stock 12 into a shape known as a hat section. The illustrated portion of the machine includes two forming stations or "passes" generally designated 14 and 16 mounted on a horizontal machine bed plate 18. Those familiar with the art will understand that the stock 12 has already been formed at other passes (not shown) starting from a flat strip of material, and the passes 14 and 16 are at or near the end of the roll forming operation wherein the transverse dimension of the stock is narrower and the vertical dimension is deeper than at the earlier stages of the roll forming operations.

The pass 14 illustrated in FIGS. 1 and 2 comprises a roll stand having an "inboard" housing 20 and an "outboard" housing 22. The outboard housing 22 comprises an upright body member having a vertically extending slot 24 and a flanged base portion 26 for removable connection to the machine bed plate 18 by bolts 28. The inboard housing 20 is also affixed to the machine bed plate 18 and has a vertically extending slot, also designated 24, aligned with the slot in the outboard housing 22. It may form the face of a drive housing which is not shown, or it may have a flanged base (not shown) for connection to the bed plate 18. The roll stand at pass 14 also includes an upper roll spindle or shaft 30 rotatably mounted in bearings 32 supported at the upper ends of the slots 24 by collars 34 affixed by bolts 36 to the housings 20 and 22. In the embodiment illustrated in FIG. 1, the upper roll shaft 30 is rotatably driven by a drive system that for purposes of illustration includes a motor driven main drive shaft 38 which is drivingly connected to the upper roll shaft 30 by bevel gears 40. Various conventional drive systems can be used and it is to be understood that the system illustrated is a simplified form of one such system.

The roll forming tooling includes an upper forming roll or die assembly, generally designated 42, which includes a forming roll or die 44 mounted on the upper roll shaft 30 intermediate the inboard and outboard housings 20 and 22. The peripheral surface of the forming roll 44 is contoured to generate the desired shape of the stock 12 to be obtained at the station 14. The roll 44 is connected by a key (not shown) to the shaft 30 so that it rotates therewith. The assembly 42 further includes plural spacers for holding the forming roll 44 in lateral alignment on the shaft 30. In accordance with this invention, the spacers include a pair of circular, larger diameter abutment plates 46 mounted in straddling relation to the forming roll 44. If needed, smaller diameter spacer members 48 may be sandwiched between the bearings 32 and the confronting faces of the abutment plates 46. The purpose of the abutment plates 46 will be further described below.

It is to be understood that the upper forming roll or die assembly 42 illustrated in the drawing is representative of many different configurations of tooling commonly used in roll forming machines. As an alternative to the construction described above, the abutment plates 46 could be integral with the forming roll 44. In accordance with common practice, the tooling assembly 42 can be removed and replaced by other tooling. For this purpose, and as will be further described below, a nut 50 is removably connected to the outer or free end of the roll shaft 30. Occasionally, spindle and forming rolls are formed as one piece. As will become apparent, this invention is usable whether the forming rolls and spindles are separate parts, as illustrated, or are integral with one another.

The roll stand at pass 14 further includes a second, lower roll spindle or shaft 52 mounted in bearings 54 to the housings 20 and 22 for rotation in inboard and outboard collars 56. The ends of the lower roll shaft 52 projecting beyond the collars 56 are gripped by removable nuts 58. In the embodiment illustrated in FIGS. 1 and 2, the lower spindle or shaft 52 is free to rotate in the bearings 54 and, during the roll forming operation, will be caused to rotate by the movement of the metal stock therealong. As will be described in connection with other embodiments, both the upper shaft 30 and the lower shaft 52 could be separately driven. Also, they could be interconnected by drive gearing designed to accommodate changes in the relative spacing of the two shafts. Such variations in the drive of roll forming machines are known and various types of drives are commonly used. Therefore, the driving mechanisms are not illustrated in greater detail herein.

The roll forming tooling further includes a lower forming roll or die assembly generally designated 60 comprising a forming roll 62, abutment plates 64, and smaller diameter spacers 66, all mounted on the lower roll shaft 52. The peripheral surface of the lower forming roll 62, which also may be made in one or more pieces, mate with the peripheral surfaces of the forming roll 44. During the roll forming operation, the mating surfaces of the two forming rolls are spaced apart sufficiently to provide clearance only for the stock 12 to pass therebetween so that the shape of the stock 12 is forced to correspond to the surfaces of the forming rolls 44 and 62. It is to be understood that the roll forming tooling will be designed for each part that is to be manufactured and the toolings at the various different stations or passes will be different for each part. The upper and lower toolings are easily removed and replaced by removal of the upper nut 50, the lower outboard nut 58, and the bolts 28 which fasten the outboard housing 22 to the machine bed 18. The outboard housing 22 is then removed to permit access to the tooling which can then be removed and replaced. As in the case of the upper forming roll assembly, variations in construction are possible. Again, the lower forming roll assembly 60 could be integral with the lower spindle 52.

The stand at pass 16 is preferably constructed identically to the stand at pass 14 except, of course, for any differences in tooling. In general, roll forming machines normally have at least two and as many as 45 and possibly even more stands, each identically constructed to the other.

In the preferred practice of this invention, the lower forming roll assembly 60 is movable vertically relative to the machine bed plate 18 from a position adjacent the upper assembly 42 for carrying out the roll forming operations to a position, shown by phantom lines 60A in FIG. 2, wherein it is spaced substantially below the upper forming roll assembly 42. For this purpose, the margins of the slots 24 in the housings 20 and 22 and the confronting sides of the collars 56 are formed with a tongue and groove construction so that the collars 56 are both guided and confined for vertical movement within the slots 24. Those familiar with the art will recognize that the illustration of the slidable mounting of the collars 56 is simplified and that abutment means (not shown) would be provided to limit the downward travel of the collars 56. The precise mode of supporting the collars within the housings 20 and 22 is unimportant for purposes of this invention, and may take any conventional form.

An important aspect of this invention is that the roll forming operations are carried out with a constant, uniform pressure applied to the forming rolls or dies, and accordingly the metal stock, by force or pressure applying means. In the presently preferred embodiment, such means comprises a hydraulic actuator engageable with each collar 56 so that the ends of the lower roll shaft 52 can both be properly located and placed under pressure. Thus with reference to FIG. 2, there is an inboard actuator generally designated 70 and an outboard actuator generally designated 72. The actuators comprise cylinders 74 and 76, respectively, affixed in any suitable fashion to the underside of the frame bed plate 18 and adapted to drive pistons 78 and 80, respectively, that project vertically through holes 82 in the plate 18 and the upper ends of which are adapted to engage the collars 56. The actuators 70 and 72 are double acting so that the lower roll shaft 52 and the lower forming roll assembly 60 thereon can be powered upwardly toward the upper forming roll assembly 42 and the actuator pistons 78 and 80 can be powered downwardly to permit the lower roll assembly 60 to drop under the force of gravity away from the upper roll assembly 42. The hydraulic actuators 70 and 72 are controlled by a hydraulic circuit, such as illustrated in FIG. 3, by which the actuators are caused to position the lower forming roll assembly 60 as described above and also by which an adjustable, uniform pressure is constantly exerted by the actuators 70 and 72 upon the lower roll shaft 52 and, accordingly, upon both forming roll assemblies 42 and 60 and the metal stock passing therebetween.

Figure 3:
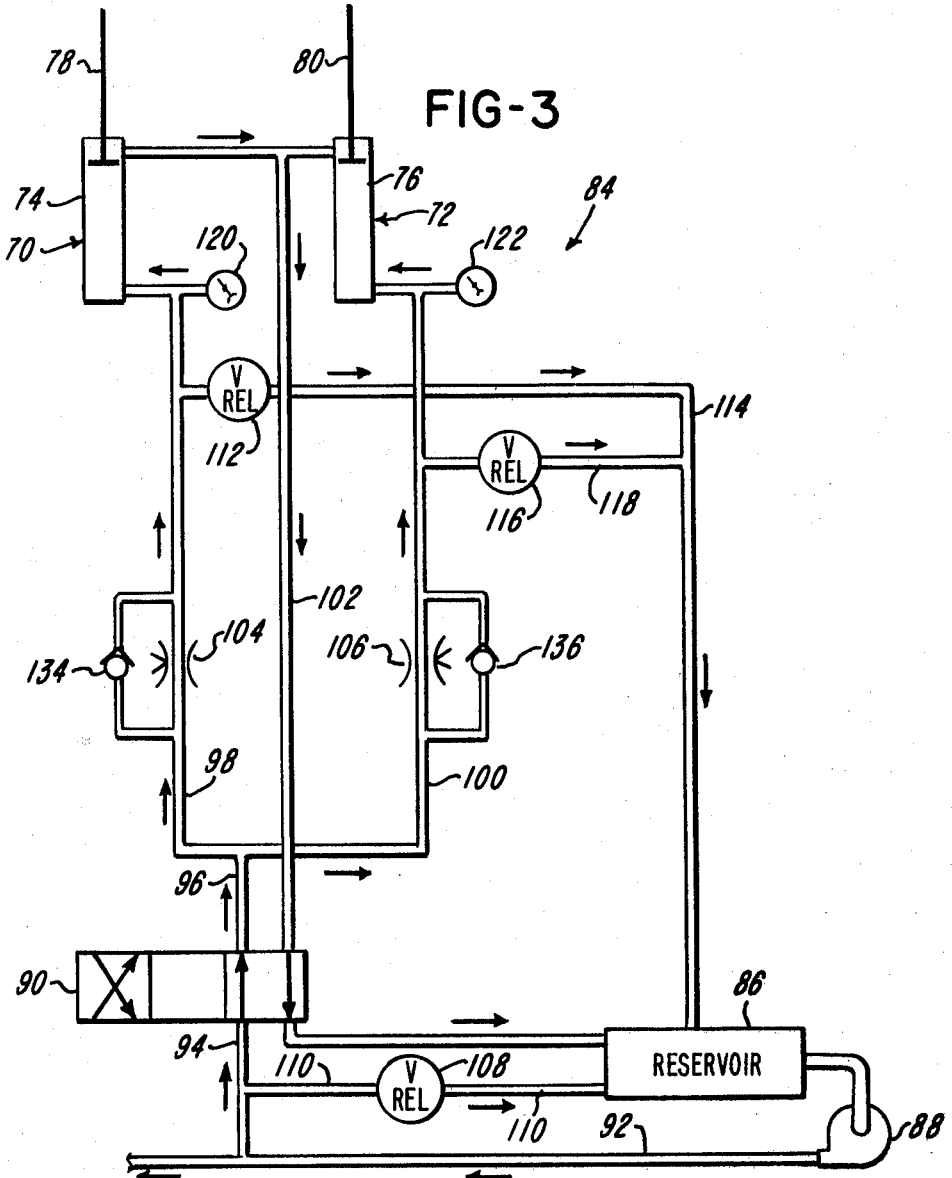
FIG. 3 is a schematic illustration of hydraulic circuitry that may be employed in the machine of FIG. 1.

Referring to FIG. 3, the actuators 70 and 72 are schematically shown in a hydraulic circuit generally designated 84 that includes a sump or reservoir 86, a pump 88, and a 3-position, 2-way main control valve 90. When the valve 90 is in the position shown in FIG. 3 and the pump 88 operating, fluid can flow through the conduits in the direction of the arrows adjacent the conduits. The conduits include a main conduit 92 that is designed so it can supply fluid under pressure to plural pairs of actuators, including the actuators 70 and 72, so that a single hydraulic pump can be used for the several passes of a complete machine. A branch conduit 94 extends from the main conduit 92 to the pump side of the valve 90. A conduit 96 extending from the actuator side of the valve 90 leads to parallel conduits 98 and 100 to the lower ends of the actuators 70 and 72 so that the pistons 78 and 80 are extended. An unrestricted, common return conduit 102 is connected to the upper ends of the cylinders 74 and 76 to provide a return path therefrom through the right side of the valve 90 to the reservoir 86.

The fluid pressure created by the pump 88 is substantially greater than the pressure that will be used to drive the actuators 70 and 72 so that the pump 88 can be used for several pairs of actuators as mentioned above. Restrictors 104 and 106 are located in the parallel conduits 98 and 100, respectively, to limit the fluid flow to the lower ends of the actuators 70 and 72. The restrictors 104 and 106 control the speed with which the pistons 78 and 80 are extended and contribute to a reduction in the size of the hydraulic system required. A pressure regulator valve 108 is located in a conduit 110 communicating between the branch conduit 94 and the reservoir 86. The valve 108 limits the pressure in the hydraulic system.

In normal operation it is contemplated that the pressure exerted upon the pistons 78 and 80 will be lower than the maximum pressure permitted by the pressure regulator valve 108. The actual pressure applied will be dependent upon the pressure needed for production of a properly shaped part. To this end, adjustable pressure regulator circuitry is provided comprising a first adjustable pressure regulator valve 112 located in a regulator conduit 114 connected to the parallel conduit 98 that supplies fluid to the cylinder 74. The regulator conduit 114 provides a return path to the reservoir 86. A second pressure regulator valve 116 is located in a regulator conduit 118 connected between the regulator return conduit 114 and the parallel conduit 100 that supplies fluid to the lower end of the cylinder 76. The pressure regulator valves 112 and 116 are effectively located in the parallel conduits 98 and 100 between the restrictors 104 and 106 and the lower ends of the cylinders 74 and 76. As will be understood by those familiar with the art, the regulator valves 112 and 116 can be set to an adjustably predetermined pressure to thereby limit the maximum pressure which can be exerted upon the pistons 78 and 80 between a minimal pressure up to the maximum pressure permitted by the regulator valve 108. The pressure exerted upon the pistons 78 and 80 is detected and displayed by pressure gauges 120 and 122, respectively, located in the parallel conduits 98 and 100.

With reference again to FIGS. 1 and 2, a pressure regulator control housing 124 can conveniently be mounted on the machine bed 18 immediately adjacent the station 14. The main control valve 90, the pressure regulator valves 112 and 116 and the gauges 120 and 122 illustrated in FIG. 3 can be located within the housing 124. Details of construction of the valves and gauges are not illustrated since these may be purchased components that can be assembled in any convenient fashion. As illustrated in FIG. 1, a control lever 126 projecting out of the housing 124 can be provided for the main control valve 90, and control knobs 128 and 130 can be provided for the regulator valves 112 and 116. As illustrated, these knobs may have pointers which can be used with scales (not shown) for setting the desired pressures. The pressure gauges 120 and 122 are exposed at the face of the housing 124 so that the pressure actually applied can be observed by the person operating the machine. There is a duplicate set of valves and gauges at each station located within similar housings. Thus, a housing 132 is shown affixed to the machine bed plate 18 adjacent the station 16.

In operation, while stock is being formed into the desired shape, the main control valve 90 is positioned as shown in FIG. 3 so that the pistons 78 and 80 will be urged upwardly with the pressure determined by the setting of the adjustable pressure regulator valves 112 and 116 and exhibited on the gauges 120 and 122. This pressure will be maintained so long as the pump 88 is in operation and the main control valve 90 remains in the FIG. 3 position. When it is desired to remove the tooling, the main control valve 90 is moved to the right as viewed in FIG. 3 so that the left side thereof is in communication with the conduits 96 and 102. Accordingly, pressure will now be applied to the upper ends of the cylinders 74 and 76. One-way bypass valves 134 and 136 are located around the restrictors 104 and 106 so that the pistons 78 and 80 may lower without restriction, whereupon the lower forming roll assembly 60 lowers to the position illustrated by phantom lines 60A in FIG. 2. The pistons 78 and 80 at this time retract to a position wherein their top surfaces are within the bed plate holes 82 to permit removal of the housings 20 and 22. When the machine is not in operation, the main control valve 90 can be moved to its center position so that there will be no fluid flowing in the hydraulic circuitry between the valve 90 and the actuators 70 and 72.

Using the apparatus described above, the initial setup of the machine to manufacture a particular part can be accomplished within a minimum amount of time. With experience, the tool designer or the setup man will normally be able to estimate the approximate optimum pressure which should be applied to the metal stock, and tests have indicated that pressures within a substantial range will often be satisfactory for manufacturing a given roll formed part. In setting up the machine, the setup man can merely jog the beginning end of a strip of metal through the various stations and, as the metal is drawn past each station, set the desired pressure to be applied and move the lever 126 or its equivalent to cause the lower roll assembly to be raised and to engage the metal stock. When pressure is applied at each end of the lower spindle, it automatically is positioned substantially parallel to the upper spindle and the predetermined pressure is applied to the stock. Often, no further adjustment will be necessary. This provides a significant advantage over existing machines wherein one roll assembly must first be positioned in parallel to the other by careful adjustment of screws. The screws must then be carefully further adjusted to obtain the desired pressure which, as already noted, is a matter of feel based upon the experience of the setup man.

After the machine is in operation, no further pressure adjustment should be necessary. In the event the metal stock undergoes a change in thickness within ordinary tolerances, the machine of this invention will normally continue to produce satisfactory parts. Thus, when the stock thickness decreases, the lower roll assembly 60 will simply move closer to the upper roll assembly 42 and continue to exert the selected pressure on the metal stock. When the thickness increases, the lower roll assembly 60 will move further away from the upper roll assembly. Accordingly, the forming rolls will always remain engaged with the metal stock and apply a uniform pressure thereto. Here it may be observed that the maximum pressure applied to the metal stock should usually be less than that pressure which would cause a reduction in the stock thickness. Provided that the pressure applied is below this limit, a machine utilizing this invention should ordinarily continue to produce satisfactory parts without the need for further adjustment. Therefore, it will be appreciated that this invention provides a substantial improvement over the machines now in use.

The pressure applied to the stock is uniform throughout a roll forming operation assuming, of course, that the pressure is not intentionally changed to accommodate extreme changes in the stock characteristics. If the trailing end of the supply of metal stock were permitted to run through the machine, the hydraulic actuators would force the lower roll assembly 60 into engagement with the upper roll assembly 42. Engagement between the forming rolls 44 and 62 could damage them. The aforementioned abutment plates 46 and 64 are designed to engage one another before the forming rolls can engage one another in the event there is no stock between the roll assemblies. In the embodiment illustrated in FIGS. 1 and 2, both pairs of abutment plates 46 and 64 preferably have the same diameters and are sized to be separated by a distance less than the stock thickness so that they will engage and smoothly roll against one another to thereby prevent engagement between the forming rolls or dies 44 and 62 if there is no stock between them. Some roll forming machines have mating upper and lower spindles that are driven at substantially different speeds. These are designed for use with forming roll sets having different base diameters. When using the present invention with such machines, the upper and lower abutment plates would preferably have correspondingly different diameters so that their peripheral speeds would be substantially equal. Of course, it should be recognized that the abutment plates 46 and 64 are optional, these being designed to protect the forming rolls under circumstances that could be avoided. Alternatively, other protective methods could be adapted.

Figure 4:
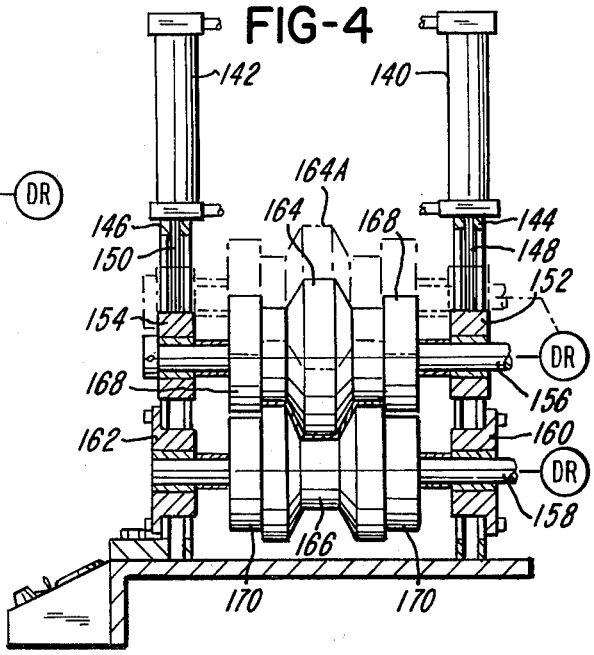
FIG. 4 is a side elevation view with parts in section of another embodiment of this invention.

FIG. 4 shows another embodiment of a roll forming machine which may be operated in substantially the same manner as the embodiment described in connection with FIGS. 1, 2 and 3. FIG. 4 shows the same parts as FIG. 2 except that a pair of hydraulic actuators 140 and 142 are mounted on top of inboard and outboard housings 144 and 146, respectively. The actuators 140 and 142 have pistons 148 and 150, respectively, that are connected to inboard and outboard collars 152 and 154 that are slidably mounted in the housings 144 and 146. An upper roll shaft or spindle 156 rotates in bearings in the collars 152 and 154. A lower roll shaft or spindle 158 rotates in bearings in collars 160 and 162 that are affixed to the housings 144 and 146. The hydraulic circuitry of FIG. 3 can be used to control the actuators 140 and 142. The operation of the apparatus of FIG. 4 is deemed apparent from the foregoing description. In this case the pistons 148 and 150 must be connected to the upper collars 152 and 154 so that the upper forming roll or die assembly, designated 164, can be moved to a position 164A remote from the lower forming roll assembly 166. As in the embodiment described above, the assemblies 164 and 166 preferably include larger diameter spacers 168 and 170 for protection of the forming rolls. The lower roll shaft or spindle may be separately powered as illustrated in FIG. 4. Optionally, only one of the upper and lower roll shafts could be powered. The embodiment illustrated in FIGS. 1, 2 and 3 is preferred because of the convenient mounting of the actuators 70 and 72 beneath the machine bed plate so that the hydraulic conduits associated therewith would be out of the way. Also it may be necessary in the embodiment of FIG. 4 to provide a separate support for the actuators 140 and 142 so that the housings 144 and 146 can be removed for servicing or for replacement of the tooling.

Figure 5:
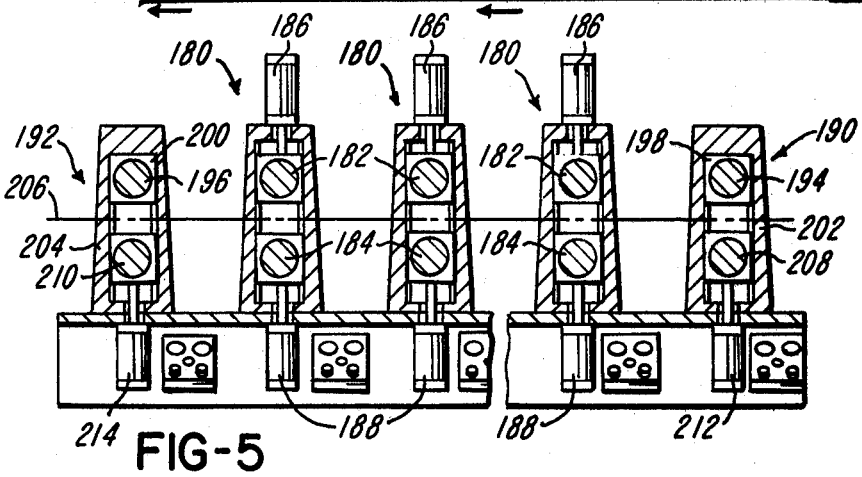
FIG. 5 is a front elevation view with parts in section of still another embodiment of this invention.

In the embodiment illustrated in FIG. 5, plural stands as indicated at 180 have both upper and lower roll shafts or spindles 182 and 184 located and placed under pressure by upper and lower hydraulic actuators 186 and 188. Either one or both of the spindles 182 and 184 could be powered. All of the stations on a machine could be constructed identially to the stations 180 and duplicate sets of hydraulic circuits of the type shown in FIG. 3 could be used to control the actuators 186 and 188. This would permit the forming dies to "float" to accommodate the part being manufactured. Preferably, however, the starting station 190 and the finishing station 192 will have at least one fixed shaft or spindle such as the illustrated upper shafts or spindles 194 and 196, these being fixed in location in the same manner described with reference to FIGS. 1 and 2. Thus, the upper spindles 194 and 196 are shown in collars 198 and 200 affixed to housings 202 and 204, respectively. By providing the fixed spindles 194 and 196 at each end of the machine or at each end of a predetermined number of stations, a pass line, such as that indicated by dot-dash line 206, for the metal stock is established. The lower roll spindles or shafts 208 and 210 at the starting and finishing stations are preferably positioned and placed under pressure by hydraulic actuators as described above in connection with FIGS. 1, 2 and 3. The embodiment of FIG. 5 offers the advantage that the pitch line for each of the floating forming rolls or dies need not be so carefully predetermined as is now the case. Slight errors in manufacture of the forming rolls can thus be tolerated. As a further alternative, a set of stands having pairs of actuators could be mounted on a bridle or the like (not shown) and thus not fixed to the bed of the machine so that the entire set of stands could float.

Those familiar with roll forming machines wll recognize that this invention is applicable to a wide variety of machines other than those illustrated herein. For example, although the invention is illustrated in connection with machines wherein the stock is formed between inboard and outboard housings, it can also be used with "outboard" machines wherein the stock is guided along a path outside the roll stands. Also it will be appreciated that the hydraulic circuit of FIG. 3 is merely representative. Other fluid circuits, including air-hydraulic circuits, are usable and other means could be used for the same purpose of maintaining a uniform pressure on the forming rolls. In all cases, however, it is desirable that the pressure applying means for each roll stand is so contructed that the pressure applied to one set of forming rolls can be adjusted independently of the other sets of forming rolls so that different pressure requirements at different stations can be accommodated. It is also desirable that the pressure applied at one point to each pair of spindles can be adjusted independently of the pressure at the other point to accommodate different pressure requirements that may be encountered along the axes of the spindles.

Although the presently preferred embodiment of this invention has been described, it will be understood that within the purview of this invention various changes may be made within the scope of the appended claims.

We claim:

1. In a roll forming machine of the type having a plurality of pairs of rolls for progressively forming stock, at least one roll of one of said pairs of rolls being movable relative to the other roll of said pair of rolls, the improvement comprising means for maintaining a substantially uniform pressure on said rolls and the stock regardless of the thickness of the stock or changes in the thickness of the stock that may occur during a roll forming operation, said means comprising fluid operated means including fluid operated actuators pressing said one roll toward said other roll, and means for adjusting the pressure maintained on said rolls comprising adjustable fluid pressure regulator means.

2. The machine of claim 1 further including means for preventing said one roll from engaging said other roll after the trailing edge of the stock passes therebetween.

3. The machine of claim 2 wherein said last mentioned means comprises first abutment means mounted adjacent and movable with said one roll and second abutment means mounted adjacent said other roll, said first and second abutment means being constructed to engage one another when there is no stock between the rolls and said one roll is pressed toward said other roll.

4. The machine of claim 3 wherein both said first abutment means and said second abutment means have circular peripheral surfaces of substantially equal diameters.

5. In a roll forming machine of the type having a plurality of pairs of forming rolls for progressively forming stock, the improvement comprising mounting means for mounting one of said rolls of one of said pairs of rolls for movement along a predetermined path toward the other of said one of said pairs of rolls, pressure applying means comprising a fluid operated actuator for moving said one of said rolls toward said other of said rolls and for applying a substantially uniform pressure to said rolls and the stock regardless of the thickness of the stock or changes in the thickness of the stock that may occur during a roll forming operation, and fluid pressure regulator means for regulating the pressure applied to said one of said rolls by said pressure applying means, said pressure regulator means being adjustable so that the pressure applied to said one of said rolls may be adjusted.

6. The machine of claim 5 wherein plural said pairs of forming rolls each include one roll mounted for movement toward the other roll and wherein said pressure applying means includes means moving each of said one rolls toward its associated other roll.

7. In a roll forming machine of the type having a plurality of pairs of forming rolls for progressively forming stock and having plural roll stands, one for each pair of rolls, each roll stand having at least one housing, a collar slidably mounted in each of said housings, a roll shaft rotatably mounted in each of said collars, one of each of said pairs of forming rolls being located on each of said roll shafts, the other of each of said pairs of forming rolls being mounted on each of said housings, the improvement comprising pressure applying means comprising plural fluid actuators, one for each of said collars engaging said collars for moving each of said one of said pairs of rolls toward the other of each of said pairs of rolls and applying a substantially uniform pressure to each of said pairs of rolls and the stock regardless of the thickness of the stock or changes in the thickness of the stock that may occur during a roll forming operation, and fluid circuit means comprising pressure means for actuating said actuators and plural pressure regulator means associated with each of said actuators so that the pressure applied to each of said pairs of rolls may be adjusted independently of the pressure applied to each of the other of said pairs of rolls.

8. The machine of claim 7 wherein each of said roll stands includes a pair of housings, said collars supporting two spaced portions of said roll shaft so that the pressure applied to said spaced portions may be independently adjusted.

9. The machine of claim 8 wherein said one roll of each of said pairs of rolls is located beneath said other roll of each of said pairs of rolls, said machine further comprising bed plate means, and wherein said roll stands are mounted on top of said bed plate means and said fluid actuators are mounted beneath said bed plate means.

10. The machine of claim 9 further comprising drive means for rotatably driving said other of said pairs of rolls.

11. The machine of claim 9 wherein said fluid actuators have pistons projecting through holes in said bed plate means and engaging said collars.

12. The machine of claim 8 wherein said one roll of each of said pairs is located above said other roll of each of said pairs.

13. The machine of claim 12 wherein said actuators are mounted on top of said housings and have pistons connected to said collars.

14. The machine of claim 8 wherein said other roll of each of said pairs of rolls is mounted on another roll shaft mounted in another pair of collars slidably mounted in said housings, and fluid actuators also engage said last mentioned collars to apply pressure thereto.

15. The machine of claim 7 further including means for preventing each pair of rolls from engaging one another.

16. The machine of claim 15 wherein said last mentioned means comprises first abutment means adjacent and rotatable with the forming surfaces of said one of said forming rolls and second abutment means adjacent and rotatable with the forming surfaces of said other of said forming rolls, said first and second abutment means confronting one another.

17. The machine of claim 16 wherein said fluid operated actuators comprise hydraulically operated actuators.

18. In a roll forming machine of the type having a support, a plurality of roll stands mounted on the support, and pairs of forming rolls mounted on said roll stands, the improvement comprising fluid operated pressure applying means for applying pressure to each pair of rolls and the stock moving therebetween and supporting at least one of the rolls of each pair of rolls, said pressure applying means being constructed to permit relative movement of said rolls so that the pressure applied to the stock passing between said rolls is substantially uniform regardless of changes in the thickness of the stock that may occur during a roll forming operation, and fluid pressure regulator means for regulating the pressure applying means to adjustably vary the pressure applied to the stock by said rolls.

19. The apparatus of claim 18 further including means for preventing engagement between the rolls of each of said pairs of rolls.

20. A forming station for a roll forming machine comprising an inboard roll stand housing, an outboard roll stand housing, an upper forming roll assembly supported by said housings, a lower forming roll assembly, at least said lower assembly being supported on said housings for vertical sliding movement, first pressure applying means adjacent said inboard housing for moving said lower roll assembly toward said upper roll assembly, second pressure applying means adjacent said outboard housing for moving said lower roll assembly toward said upper roll assembly, first regulating means for regulating said first pressure applying means for applying a substantially uniform pressure to said lower roll assembly regardless of changes that may occur during a forming operation in the thickness of the stock being formed, second regulating means for regulating said second pressure applying means for applying a substantially uniform pressure to said lower roll assembly regardless of changes that may occur during a forming operation in the thickness of the stock being formed, and means for independently adjusting said first and said second regulating means for varying the pressure applied to said lower roll assembly.

21. The forming station of claim 20 wherein said first and said second pressure applying means comprise hydraulic actuators, and said first and second regulating means both include regulator valve means.

22. The forming station of claim 20 wherein said upper forming roll assembly includes upper forming roll means and said lower forming roll assembly includes lower forming roll means, said forming roll assemblies further including means for preventing engagement between said upper and said lower forming roll means.

23. The forming station of claim 22 wherein said means for preventing engagement comprises abutment means mounted adjacent both sides of both of said forming roll means.

24. The machine of claim 23 wherein said abutment means have circular peripheral surfaces of substantially equal diameters.

25. In a roll forming machine, the combination comprising: a machine bed means, plural horizontally spaced pairs of roll stands mounted on said machine bed means, plural pairs of vertically spaced roll shafts, one pair for each of said roll stands, support means for supporting said pairs of roll shafts on said stands including means for slidably supporting at least one of each of said pairs of roll shafts on each pair of stands, said support means including collars rotatably receiving said one of each of said pair of roll shafts, and pressure applying means comprising fluid operated actuators affixed to said machine bed means for applying a substantially uniform pressure to said collars throughout a forming operation regardless of changes in the thickness of the stock being formed wherein said machine bed means includes bed plate means, said roll stands being mounted on top of said bed plate means and said actuators being mounted beneath said bed plate means and having pistons projecting through holes in said bed plate means into engagement with said collars.

26. The machine of claim 25 wherein said pressure applying means comprises hydraulic actuators.

27. The machine of claim 25 wherein said pistons are retractable out of engagement with said collars into said holes to permit removal of said roll stands.

28. In a roll forming machine, the combination comprising: a machine bed means, plural horizontally spaced pairs of roll stands mounted on said machine bed means, plural pairs of vertically spaced roll shafts, one pair for each of said roll stands, support means for supporting said pairs of roll shafts on said stands including means for slidably supporting at least one of each of said pairs of roll shafts on each pair of stands, said support means including collars rotatably receiving said one of each of said pairs of roll shafts, and pressure applying means comprising fluid operated actuators affixed to said machine bed means for applying a substantially uniform pressure to said collars throughout a forming operation regardless of changes in the thickness of the stock being formed and fluid circuit means including pressure regulator means for controlling said actuators, said pressure regulator means comprising means mounted on said machine bed means adjacent each of said roll stands.

29. The machine of claim 28 wherein said fluid operated actuators comprise hydraulically operated actuators.

* * * * *